US005651261A

United States Patent [19]

Nakajima et al.

[11] Patent Number: 5,651,261

[45] Date of Patent: Jul. 29, 1997

[54] OPERATION CONTROL DEVICE FOR AIR CONDITIONER

[75] Inventors: Hiroto Nakajima; Seiki Inoue; Seiji Sakai, all of Osaka, Japan

[73] Assignee: Daikin Industries, Ltd., Osaka, Japan

[21] Appl. No.: 454,283

[22] PCT Filed: Oct. 25, 1994

[86] PCT No.: PCT/JP94/01783

§ 371 Date: Jun. 15, 1995

§ 102(e) Date: Jun. 15, 1995

[87] PCT Pub. No.: WO95/12097

PCT Pub. Date: May 4, 1995

[30] Foreign Application Priority Data

Oct. 29, 1993 [JP] Japan ..... 5-272009

[51] Int. Cl.[6] ..... F25B 47/02

[52] U.S. Cl. ..... 62/155; 62/278; 62/509

[58] Field of Search ..... 62/155, 156, 151, 62/278, 81, 503, 509, 197, 324.1, 324.5, 160, 277, 234, 324.6, 196.4

[56] References Cited

U.S. PATENT DOCUMENTS

| | | | |
|---|---|---|---|
| 3,343,375 | 9/1967 | Quick | 62/81 |
| 4,167,102 | 9/1979 | Willitts | 62/509 X |
| 4,313,313 | 2/1982 | Chrostowski et al. | 62/278 |
| 4,987,747 | 1/1991 | Nakamura et al. | 62/324.6 X |
| 5,309,733 | 5/1994 | Hayashida et al. | 62/278 |

FOREIGN PATENT DOCUMENTS

| | | |
|---|---|---|
| 53-141547 | 4/1977 | Japan . |
| 63-120063 | 8/1988 | Japan . |
| 4344085 | 11/1992 | Japan . |

*Primary Examiner*—Harry B. Tanner

*Attorney, Agent, or Firm*—Sixbey, Friedman, Leedom & Ferguson, P.C.; Gerald J. Ferguson, Jr.

[57] ABSTRACT

A receiver (4) is provided in a main line (9*a*) and a bypass passage (4*a*) having an open/shut-off valve (SV) is provided for introducing gas refrigerant in the receiver (4) into a low-pressure liquid line. A motor-operated expansion valve (5) is fully closed, the open/shut-off valve (SV) is opened, and then defrosting operation is executed. At the initial stage of the defrosting operation, the open/shut-off valve (SV) is closed. When a discharge-pipe temperature Td drops to or below a specified temperature, the open/shut-off valve (SV) is closed. When the discharge-pipe temperature Td rises to or above a specified temperature, the motor-operated expansion valve (5) is once opened to a specified opening. When defrosting operation is completed, the open/shut-off valve (SV) is opened in a heating cycle and the motor-operated expansion valve (5) is gradually opened.

7 Claims, 8 Drawing Sheets

20
8c2
8r
9a
D3
D4
S
Q
8b1
C
8f
8c1
R
F3
8b2
D1
D2
V1
P
4a
8Y
8a
8X
4
5
F2
3a
Thc
3f
Tha
3
F1
9
8
Thd
2
ER
LPS
HPS
1
9a
9a
A
14
15
10
11
12
13
Thr
B
6f
6
The
F4

20
Thc
3f
Tha
3
F1
9
8
3a
8b1
8c2
S
D4
8r
Q
9a
D3
8c1
R
F3
8b2
8f
C
D1
F2
5
4
P
4a
8X
D2
V2
8Y
8a
2
ER
LPS
HPS
Thd
1
9a
9a
A
13A2
14A2
10
11A2
12A2
B
Thr
6f
6
The
F4

OPERATION CONTROL DEVICE FOR AIR CONDITIONER

TECHNICAL FIELD

This invention relates to an operation control device for air conditioner, and particularly relates to measures for controlling the air conditioner during defrosting operation and for controlling the air conditioner just after completion of defrosting operation.

BACKGROUND ART

There has been a conventional air conditioner which is so composed that an indoor unit is connected to an outdoor unit in which a compressor, a four-way selector valve, a thermal-source-side heat exchanger, a motor-operated expansion valve and a receiver are sequentially connected, as disclosed in Japanese Patent Application Laid-Open Gazette No. 4-344085. The air conditioner performs defrosting operation when a fin of the thermal-source-side heat exchanger is frosted in heating operation.

Further, the defrosting operation is executed in a cooling cycle with a non-shown motor-operated expansion valve of the indoor unit and the motor-operated expansion valve of the outdoor unit fully opened together.

Problems to be solved

However since the above air conditioner is provided with an accumulator on a suction side of the compressor in order to prevent operation in wet condition of the compressor, the motor-operated expansion valves are fully opened in the defrosting operation so that operation performance is decreased due to pressure loss at the accumulator.

If the accumulator is not provided to solve the above problem, since the defrosting operation with the motor-operated expansion valves fully opened, this causes liquid refrigerant condensed by the thermal-source-side heat exchanger to store in the receiver in the case of heavy frost, low open-air temperature or short refrigerant piping. Thus, an amount of heat required for defrosting is lacked so that the liquid refrigerant in the receiver turns back to the compressor. This invites operation in wet condition of the compressor, so that the compressor is under stress. As a result, the reliability of the compressor is reduced.

In view of the foregoing problems, this invention has been made. An object of this invention is to enhance operation performance without any accumulator while avoiding the compressor from operating in wet condition in defrosting operation.

DISCLOSURE OF INVENTION

To achieve the above object, measures instituted in this invention are so composed as to execute defrosting operation while introducing gas refrigerant in a receiver into a main line through a bypass passage.

Constitution

More specifically, as shown in FIG. 1, a measure instituted in the invention premises an air conditioner comprising a refrigerant circuit (9) which has a main line (9*a*) in which a compressor (1), a thermal-source-side heat exchanger (3), an expansion mechanism (5) freely adjustable in opening and a used-side heat exchanger (6) are sequentially connected and which is reversibly operable between cooling cycle operation and heating cycle operation.

A receiver (4) is provided in a high-pressure liquid line of the main line (9*a*) of the refrigerant circuit (9). There is provided a bypass passage (4*a*), which is connected at one end thereof to the receiver (4) and at the other end to a low-pressure liquid line of the main line (9*a*) of the refrigerant circuit (9), for bypassing the expansion mechanism (5) to introduce gas refrigerant in the receiver (4) into the low-pressure liquid line.

Further, the bypass passage (4*a*) is provided with open/shut-off means (SV) for opening and shutting off the bypass passage (4*a*).

In addition, there is provided defrosting executing means (11) for making the expansion mechanism (5) fully closed and making the open/shut-off means (SV) open according to a defrosting requiring signal in the heating cycle operation and executing defrosting operation in the reverse cycle.

A further measure instituted in the invention comprises initial control means (12) for outputting an initially closing signal to the defrosting executing means (11) so that the open/shut-off means (SV) is closed until a set time passes after the start of the defrosting operation.

A further measure instituted in the invention comprises wet condition control means (13) for outputting a closing signal to the defrosting executing means (11) so that the open/shut-off means (SV) is closed when a refrigerant temperature on a discharge side of the compressor (1) drops to or below a specified temperature.

A further measure instituted in the invention is so composed that the wet condition control means (13) outputs a closing signal so that the open/shut-off means (SV) becomes an opened state after holding a closed state for a set time, and then outputs an opening holding signal to the defrosting executing means (11) so that the open/shut-off means (SV) holds the opened state for a set time after closed.

A further measure instituted in the invention comprises superheating control means (14) for outputting respective signals for opening and closing the motor-operated expansion valve (5) to the defrosting executing means (11) so that when a refrigerant temperature on a discharge side of the compressor (1) rises to or above a specified temperature, the expansion mechanism (5) is opened to a specified opening and then closed into a fully closed state.

A further measure instituted in the invention is so composed that the superheating control means (14) outputs a full-close holding signal to the defrosting executing means (11) so that the expansion mechanism (5) holds the fully closed state for a set time after opened and closed.

A further measure instituted in the invention comprises operation sifting means (15) for shifting the circuit to heating cycle operation when the defrosting executing means (11) completes the defrosting operation, so as to control the open/shut-off means (SV) to hold it open for a set time in a heating cycle and then turn it closed while controlling the expansion mechanism (5) to gradually open it to a specified opening.

In further measure instituted in the invention, the bypass passage (4*a*), the open/shut-off means (SV) and the defrosting executing means (11) are substituted by respective other means. More specifically, in one measure instituted in the invention, there is provided a bypass passage (4*a*), which is connected at one end thereof to the receiver (4) and at the other end to a high-pressure side of the expansion mechanism (5) of the refrigerant circuit (9), for introducing gas refrigerant in the receiver (4) into the high-pressure side of the expansion mechanism (5).

Further, there is provided selector means (V2) switchable between a bypass communication state in which the high-pressure side of the expansion mechanism (5) is communicated with the bypass passage (4*a*) and a main line communication state in which the high-pressure side of the expansion mechanism (5) is communicated with the high-pressure liquid line of the main line (9*a*).

In addition, there is provided defrosting executing means (11A1) for switching the selector means (V2) to the bypass communication state and opening the expansion mechanism (5) according to a defrosting requiring signal and executing defrosting operation.

On the other hand, in another measure instituted in the invention, there is provided a bypass passage (4*a*), which is connected at one end thereof to the receiver (4) and at the other end to a low-pressure liquid line of the main line (9*a*) of the refrigerant circuit (9), for bypassing the expansion mechanism (5) to introduce gas refrigerant in the receiver (4) into the low-pressure liquid line.

Further, there is provided selector means (V2) switchable between a bypass communication state in which the low-pressure liquid line of the main line (9*a*) is communicated with the bypass passage (4*a*) and a main line communication state in which the low-pressure liquid line of the main line (9*a*) is communicated with the low-pressure side of the expansion mechanism (5).

In addition, there is provided defrosting executing means (11A2) for switching the selector means (V2) to the bypass communication state according to a defrosting requiring signal in the heating cycle operation and executing defrosting operation.

Another measure instituted in the invention comprises, instead of the initial control means (12) of the invention, initial control means (12A1) for outputting an initially closing signal to the defrosting executing means (11A1) so that the expansion mechanism (5) holds a fully closed state until a set time passes after the start of the defrosting operation.

On the other hand, a further measure instituted in the invention comprises, instead of the initial control means (12) of the invention, initial control means (12A2) for outputting an initially closing signal to the defrosting executing means (11A2) so that until a set time passes after the start of the defrosting operation, the selector means (V2) holds the main line communication state and the expansion mechanism (5) holds a fully closed state.

Further, a further measure instituted in the invention comprises, instead of the previously mentioned wet condition control means (13), wet condition control means (13A1) for outputting a fully closing signal to the defrosting executing means (11A1) so that the motor-operated expansion valve (5) is fully closed when a refrigerant temperature on a discharge side of the compressor (1) drops to or below a specified temperature.

On the other hand, a further measure instituted in the invention comprises, instead of the previously mentioned wet condition control means (13), wet condition control means (13A2) for outputting a fully closing signal to the defrosting executing means (11A2) so that when a refrigerant temperature on a discharge side of the compressor (1) drops to or below a specified temperature, the selector means (V2) is switched to the main line communication state and the expansion mechanism (5) is fully closed.

Furthermore, another measure instituted in the invention is so composed that the wet condition control means (13A1) outputs a fully closing signal to the defrosting executing means (11A1) so that the expansion mechanism (5) is opened after holding a fully closed state for a set time, and then outputs an opening holding signal to the defrosting executing means (11A1) so that the expansion mechanism (5) holds the opened state for a set time after fully closed.

Moreover, a further measure instituted in the invention so composed that the wet condition control means (13A2) outputs a switching signal to the defrosting executing means (11A2) so that the selector means (V2) is switched to the bypass communication state after the expansion mechanism (5) holds a fully closed state for a set time, and then outputs a switching holding signal to the defrosting executing means (11A2) so that the selector means (V2) holds for a set time the bypass communication state switched from the main line communication state for a set time.

A further measure instituted in the invention comprises, instead of the previously mentioned superheating control means (14), superheating control means (14A1) for outputting a first and second switching signal to the defrosting executing means (11A1) so that when a refrigerant temperature on a discharge side of the compressor (1) rises to or above a specified temperature, the selector means (V2) is first switched to the main line communication state and then switched again to the bypass communication state.

On the other hand, a further measure instituted in the invention comprises, instead of the previously mentioned superheating control means (14), superheating control means (14A2) for outputting a first and second switching signal to the defrosting executing means (11A2) so that when a refrigerant temperature on a discharge side of the compressor (1) rises to or above a specified temperature, the selector means (V2) is first switched to the main line communication state while the expansion mechanism (5) is opened and then the selector means (V2) is switched again to the bypass communication state.

A further measure instituted in the invention is so composed that the superheating control means (14A1) outputs a switching holding signal to the defrosting executing means (11A1) so that the selector means (V2) holds for a set time the bypass communication state switched from the main line communication state.

Further, a further measure instituted in the invention is so composed that the superheating control means (14A2) outputs a switching holding signal to the defrosting executing means (11A2) so that the selector means (V2) holds for a set time the bypass communication state switched from the main line communication state.

Operations

Under the above structure, when the defrosting executing means (11) starts defrosting operation in a reverse cycle according to a defrosting requiring signal, it makes the open/shut-off means (SV) open while making the expansion mechanism (5) fully closed.

Otherwise, the defrosting executing means (11A1) switches the selector means (V2) to the bypass communication state and fully opens the expansion mechanism (5). Alternatively, the defrosting executing means (11A2) switches the selector means (V2) to the bypass communication state. Then, in such conditions the defrosting executing means (11, 11A1, 11A2) circulates gas refrigerant in the receiver (4) into the main line through the bypass passage (4*a*) thereby executing defrosting operation.

Further, at the initial stage of the defrosting operation, the open/shut-off means (SV) is closed while the selector means (V2) is switched to the main line communication state and the expansion mechanism (5) is fully closed. In other words, both the main line (9*a*) and the bypass passage (4*a*) are shut off thereby preventing turning back of liquid refrigerant from the receiver (4).

Then, in the case where a refrigerant temperature on a discharge side of the compressor (1) drops to or below a specified temperature in the defrosting operation, the open/shut-off means (SV) is closed, while the selector means (V2) is switched to the main line communication state and the expansion mechanism (5) is fully closed. In other words, since liquid refrigerant in the receiver (4) may turn back to the compressor (1), both the main line (9a) and the bypass passage (4a) are shut off thereby preventing turning back of liquid refrigerant from the receiver (4).

Subsequently, the open/shut-off means (SV) is held in an opened state for a set time after it is closed. Otherwise, the selector means (V2) is switched from the main line communication state to the bypass communication state and the expansion mechanism (5) is held in an opened state for a set time. Alternatively, the selector means (V2) is switched from the main line communication state to the bypass communication state and is held in this state for a set time. In other words, it is prevented to excessively execute opening/closing operation of the open/shut-off means (SV) and the expansion mechanism (5) and switching operation of the selector means (V2), thereby avoiding operation in superheated condition of the compressor (1).

On the other hand, in the case where a refrigerant temperature on a discharge side of the compressor (1) rises to or above a specified temperature in the defrosting operation, the expansion mechanism (5) is opened, the selector means (V2) is switched to the main line communication state and then switched back to the bypass communication state, or otherwise the selector means (V2) is switched to the main line communication state while the expansion mechanism (5) is opened and then the selector means (V2) is switched back to the bypass communication state. In other words, liquid refrigerant in the receiver (4) is turned back so that the superheated refrigerant temperature is decreased, thereby preventing operation in superheated condition of the compressor (1).

Subsequently, the expansion mechanism (5) is held in the fully closed state for a set time after opened and closed while the selector means (V2) is held in the bypass communication state switched from the main line communication state for a set time. In other words, it is prevented to excessively execute opening/closing operation of the expansion mechanism (5) and switching operation of the selector means (V2), thereby avoiding operation in wet condition of the compressor (1).

Thereafter, when the defrosting operation is completed, the open/shut-off means (SV) is held in an opened state for a set time and is then closed while the expansion mechanism (5) is gradually opened, thereby preventing turning back of liquid refrigerant while ensuring the minimum circulation amount of refrigerant, so that heating cycle operation is restarted.

Effects

Since gas refrigerant in the receiver (4) is introduced into the main line (9a) through the bypass passage (4a) in the defrosting operation, when liquid refrigerant condensed in the thermal-source-side heat exchanger (3) is stored into the receiver (4) in the case of heavy frost, low open-air temperature or short refrigerant piping, liquid refrigerant in the receiver (4) can be securely prevented from turning back to the compressor (1) without provision of any accumulator. As a result, operation in wet condition of the compressor (1) is securely prevented so that the compressor (1) is subjected to no stress, thereby enhancing reliability of the compressor (1).

Further, since no accumulator is needed, pressure loss can be decreased thereby enhancing operation performance, and the number of elements are reduced thereby resulting in cost reduction.

Since both the main line (9a) and the bypass passage (4a) are shut off at the initial stage of the defrosting operation, it can be securely prevented that liquid refrigerant in the receiver (4) flows into the thermal-source-side heat exchanger (3) and the used-side heat exchanger (6) due to variation in pressure of the refrigerant circuit. Thus, turning back of liquid refrigerant to the compressor (1) can be prevented and a condensation area in the thermal-source-side heat exchanger (3) can be sufficiently ensured, so that defrosting performance can be increased.

Since both the main line (9a) and the bypass passage (4a) are shut off when a refrigerant temperature on a discharge side of the compressor (1) drops in the defrosting operation, liquid refrigerant on a suction side of the compressor (1) can be evaporated. Consequently, turning back of liquid refrigerant can be prevented so that operation in wet condition of the compressor (1) can be securely prevented, thereby further enhancing reliability of the compressor (1).

Further, since communication With the bypass passage (4a) is held for a set time after both the main line (9a) and the bypass passage (4a) are shut off, the compressor (1) can be prevented in advance from operation in superheated condition due to frequent shutting-off control of the refrigerant circuit.

When a refrigerant temperature on a discharge side of the compressor (1) rises in the defrosting operation, the expansion mechanism (5) is opened and communication is established in the main line (9a). Thus, liquid refrigerant is turned back to cool down superheated refrigerant on a suction side of the compressor (1), so that operation in superheated condition of the compressor (1) can be securely prevented thereby further enhancing reliability of the compressor (1).

Further, since communication with the bypass passage (4a) is held for a set time once the expansion mechanism (5) is opened, the compressor (1) can be prevented in advance operation in wet condition due to frequent communication control of the main line (9a).

When the defrosting operation is completed, the open/shut-off means (SV) is opened and the expansion mechanism (5) is gradually opened. Since this ensures the minimum circulation amount of refrigerant at the shift to heating operation, heating performance can be increased. Further, since turning back of liquid refrigerant to the compressor (1) can be prevented, operation in wet condition of the compressor (1) can be prevented while dilution of lubricating oil in the compressor (1) can be prevented.

BEST MODE FOR CARRYING OUT THE INVENTION

Below, embodiments of this invention will be described with reference to the drawings.

Embodiment 1

Figure 1:
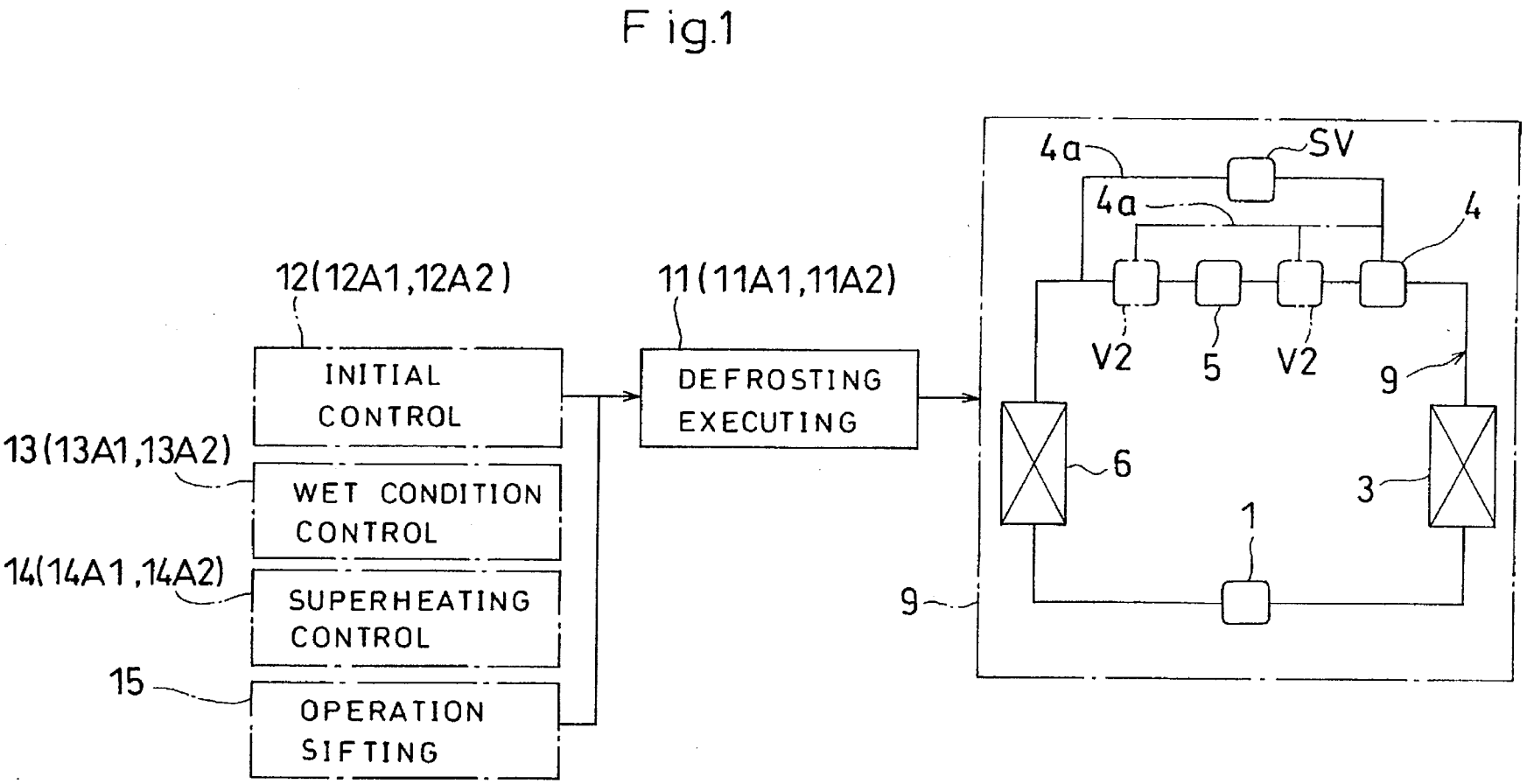
FIG. 1 is a block diagram showing the structure of the present invention.
Figure 2:
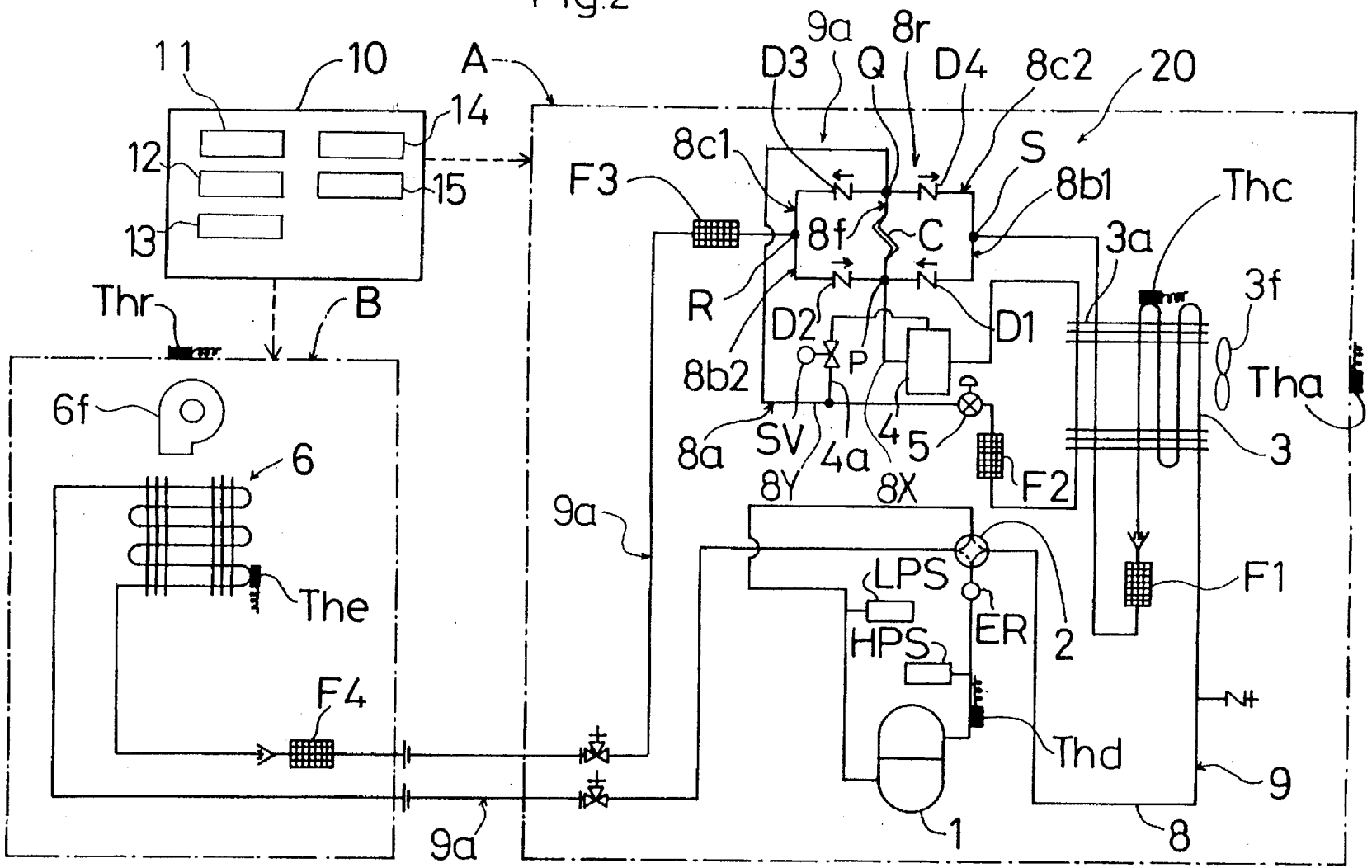
FIG. 2 is a refrigerant circuit diagram showing an embodiment of the invention.

FIG. 2 shows a refrigerant piping system of an air conditioner applying this invention, which is a so-called separate type one in which a single indoor unit (B) is connected to a single outdoor unit (A).

The outdoor unit (A) comprises a compressor (1) of scroll type to be variably adjusted in operational frequency by an inverter, a four-way selector valve (2) switchable as shown in a solid line of FIG. 2 in cooling operation and in a broken line of FIG. 2 in heating operation, an outdoor heat exchanger (3) as a thermal-source-side heat exchanger which functions as a condenser in cooling operation and as an evaporator in heating operation, and a pressure reduction part (20) for reducing refrigerant in pressure. The outdoor heat exchanger (3) is provided with an outdoor fan (3*f*).

In the indoor unit (B), there is disposed an indoor heat exchanger (6) as a used-side heat exchanger which functions as an evaporator in cooling operation and as a condenser in heating operation. The indoor heat exchanger (6) is provided with an indoor fan (6*f*).

The compressor (1), the four-way selector valve (2), the outdoor heat exchanger (3), the pressure reduction part (20) and the indoor heat exchanger (6) are sequentially connected through refrigerant piping (8), thereby forming a refrigerant circuit (9) in which circulation of refrigerant causes heat transfer.

The pressure reduction part (20) includes a bridge-like rectification circuit (8*r*) and a common passage (8*a*) connected to a pair of connection points (P, Q) of the rectification circuit (8*r*). In the common passage (8*a*), there are arranged in series a receiver (4), which is placed in an upstream-side common passage (8X) serving as a high-pressure liquid line at any time, for storing liquid refrigerant, an auxiliary heat exchanger (3*a*) for outdoor heat exchanger (3), and a motor-operated expansion valve (5) freely adjustable in opening, which serves as an expansion mechanism having a function of reducing liquid refrigerant in pressure and a function of adjusting a flow rate of liquid refrigerant.

Another pair of connection points (R, S) of the rectification circuit (8*r*) are connected to the indoor heat exchanger (6) side of the refrigerant piping (8) and the outdoor heat exchanger (3) side of the refrigerant piping (8) respectively. There is formed a main line (9*a*) in which the compressor (1), the four-way selector valve (2), the outdoor heat exchanger (3), the rectification circuit (8*r*) and the common passage (8*a*) are sequentially connected and the rectification circuit (8*r*), the indoor heat exchanger (6), the four-way selector valve (2) and the compressor (1) are sequentially connected.

Further, the rectification circuit (8*r*) is provided with: a first inflow passage (8*b*1) which connects the up-stream-side connection point (P) of the common passage (8*a*) to the connection point (S) on the outdoor heat exchanger (3) side and has a first non-return valve (D1) for allowing refrigerant to flow only in a direction from the outdoor heat exchanger (3) to the receiver (4); a second inflow passage (8*b*2) which connects the upstream-side connection point (P) of the common passage (8*a*) to the connection point (R) on the indoor heat exchanger (6) side and has a second non-return valve (D2) for allowing refrigerant to flow only in a direction from the indoor heat exchanger (6) to the receiver (4); a first discharge passage (8*c*1) which connects the downstream-side connection point (Q) of the common passage (8*a*) to the connection point (R) on the indoor heat exchanger (6) side and has a third non-return valve (D3) for allowing refrigerant to flow only in a direction from the motor-operated expansion valve (5) to the indoor heat exchanger (6); and a second discharge passage (8*c*2) which connects the downstream-side connection point (Q) of the common passage (8*a*) to the connection point (S) on the outdoor heat exchanger (3) side and has a fourth non-return valve (D4) for allowing refrigerant to flow only in a direction from the motor-operated expansion valve (5) to the outdoor heat exchanger (3).

Between both the connection points (P, Q) of the common passage (8*a*) of the rectification circuit (8*r*), a liquid seal preventing bypass passage (8*f*) provided with a capillary tube (C) is formed. The liquid seal preventing bypass passage (8*f*) prevents liquid seal at the deactivation of the compressor (1). Further, between the upper part of the receiver (4) and a part of the downstream-side common passage (8Y) which is located on a downstream side of the motor-operated expansion valve (5) and serves as a low-pressure liquid line at any time, there is provided an open/shut-off valve (SV) as open/shut-off means connected to a bypass passage (4*a*) for bypassing the motor-operated expansion valve (5), thereby venting gas refrigerant stored in the receiver (4).

Figure 3:
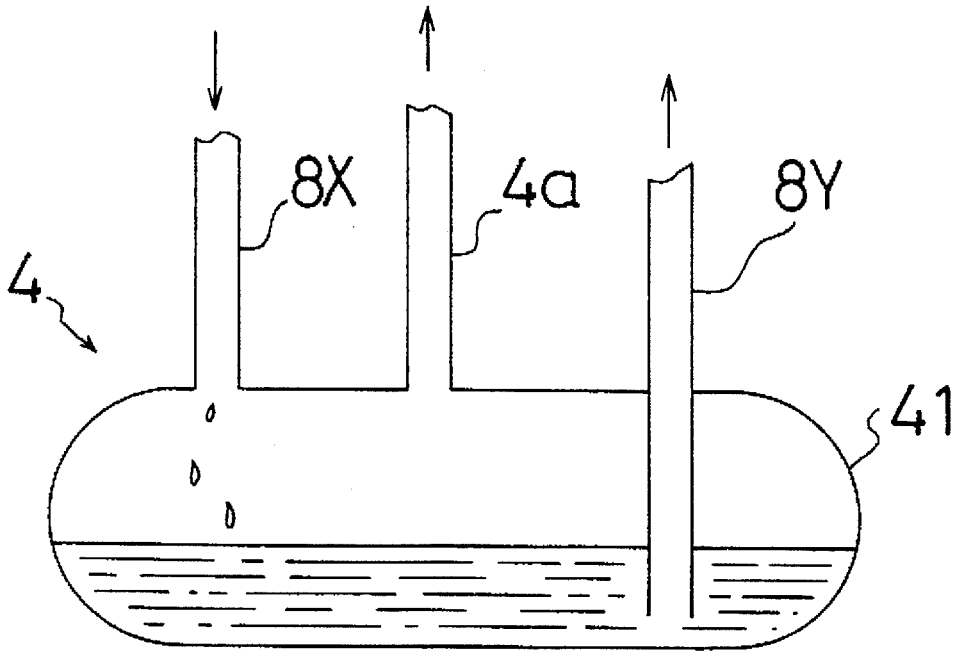
FIG. 3 is a schematic diagram showing a receiver.

In detail, as shown in FIG. 3, the receiver (4) is connected at a body casing (41) thereof to the upstream-side common passage (8X), the downstream-side common passage (8Y) and the bypass passage (4*a*). The downstream-side common passage (8Y) is introduced into an inner bottom part of the body casing (41) in order that liquid refrigerant is discharged therefrom. The bypass passage (4*a*) is connected to the upper part of the body casing (41) in order that gas refrigerant is discharged therefrom.

The degree of pressure reduction of the capillary tube (C) is set at a sufficiently larger value than the motor-operated expansion valve (5) so that the motor-operated expansion valve (5) adequately maintains the function of adjusting a flow rate of refrigerant in normal operation.

(F1 to F4) indicate filters for removing dusts from refrigerant, and (ER) indicates a silencer for reducing operational sound of the compressor (1).

The air conditioner is provided with various sensors. (Thd) is a discharge pipe sensor, which is disposed in a discharge pipe of the compressor (1), for sensing a discharge-pipe temperature Td as a refrigerant temperature on a discharge side of the compressor (1). (Tha) is an outdoor inlet sensor, which is disposed in an air inlet of the outdoor unit (A), for sensing an outdoor-air temperature Ta as an open-air temperature. (Thc) is an outdoor heat-exchange sensor, which is disposed in the outdoor heat exchanger (3), for sensing an outdoor heat-exchange temperature Tc as a condensation temperature in cooling operation and as an evaporation temperature in heating operation. (Thr) is an indoor inlet sensor, which is disposed in an air inlet of the indoor unit (B), for sensing an indoor-air temperature Tr as a room temperature. (The) is an indoor heat-exchange sensor, which is disposed in the indoor heat exchanger (6), for sensing an indoor heat-exchange temperature Te as an evaporation temperature in cooling operation and as a condensation temperature in heating operation. (HPS) is a high-pressure-control pressure switch for sensing a pressure of high-pressure refrigerant and turning on at the excessive rise in pressure of high-pressure refrigerant to output a high-pressure signal. (LPS) is a low-pressure-control pressure switch for sensing a pressure of low-pressure refrigerant and turning on at the excessive drop in pressure of low-pressure refrigerant to output a low-pressure signal.

Respective output signals of the sensors (Thd to The) and the switches (HPS, LPS) are inputted into a controller (10).

The controller (10) is so composed as to control air conditioning according to the input signals.

In the above-mentioned refrigerant circuit (9), circulation of refrigerant in cooling operation is made in the following manner. Refrigerant is condensed in the outdoor heat exchanger (3) so as to be liquefied. Liquid refrigerant thus liquefied flows through the first non-return valve (D1) from the first inflow passage (**8*b*1), is then stored in the receiver (4), is reduced in pressure by the motor-operated expansion valve (5), flows through the first discharge passage (8*c*1), and is evaporated in the indoor heat exchanger (6). Refrigerant thus evaporated returns to the compressor (1). On the other hand, circulation of refrigerant in heating operation is made in the following manner. Refrigerant is condensed in the indoor heat exchanger (6) so as to liquefied. Liquid refrigerant thus liquefied flows through the second non-return valve (D2) from the second inflow passage (8*b*2), is then stored in the receiver (4), is reduced in pressure by the motor-operated expansion valve (5), flows through the second discharge passage (8*c*2), and is evaporated in the outdoor heat exchanger (3). Refrigerant thus evaporated returns to the compressor (1**).

The controller (10) sections an operational frequency of the inverter into 20 steps N from zero to the maximum frequency, controls the capacity of the compressor (1) by finding out each frequency step N so that the discharge-pipe temperature Td becomes an optimum discharge-pipe temperature, and controls the opening of the motor-operated expansion valve (5) so that the discharge-pipe temperature Td becomes an optimum discharge-pipe temperature.

The controller (10) has, as a feature of this invention, a defrosting executing means (11), an initial control means (12), a wet condition control means (13), a superheating control means (14) and an operation shifting means (15).

The defrosting executing means (11) is so composed as to make the motor-operated expansion valve (5) fully closed and make the open/shut-off valve (SV) open according to a defrosting requiring signal outputted when the refrigerant circuit (9) becomes specified conditions and to execute defrosting operation in the reverse cycle.

For example, the controller (10) memorizes the sum of heating performance from the start of heating operation after the end of defrosting operation, divides the sum of heating performance by the period of time that a heating operation period after the end of defrosting operation and a defrosting operation period to be preliminary expected are added to calculate a mean value of heating performance, and outputs a defrosting requiring signal when the mean value of heating performance is below the last-time mean value of heating performance.

In any one of the case that the frequency step N of the compressor (1) drops to 6, the case that the discharge-pipe temperature Td rises above 110° C. and the case that the defrosting operation period becomes longer than 10 minutes, the defrosting executing means (11) completes the defrosting operation.

The initial control means (12) outputs an initially closing signal to the defrosting executing means (11), until a set time passes from the start of the defrosting operation, e.g., until 15 seconds pass, so as to make the open/shut-off valve (SV) closed, thereby closing the refrigerant circuit (9) for 15 seconds.

The wet condition control means (13) outputs a closing signal for closing the open/shut-off valve (SV) to the defrosting executing means (11), so that when the discharge-pipe temperature Td of the compressor (1) drops below a specified temperature, e.g., 85° C., the open/shut-off valve (SV) holds a closed state for a set time and then becomes an opened state, e.g., for 20 seconds. Further, the wet condition control means (13) outputs an opening holding signal to the defrosting executing means (11) so that the open/shut-off valve (SV) holds for a set time the opened state after closed, e.g., so that the open/shut-off valve (SV) holds the opened state for 30 seconds by activating a timer for 50 seconds after the output of the closing signal.

The superheating control means (14) outputs respective signals for opening and closing the motor-operated expansion valve (5) to the defrosting executing means (11), so that when the discharge-pipe temperature Td of the compressor (1) rises above a specified temperature, e.g., 90° C., the motor-operated expansion valve (5) is opened to a specified opening and then closed into a fully closed state. In other words, the superheating control means (14) once opens the motor-operated expansion valve (5) of a fully closed state to a partially opened state of 200 pulses, in which a fully opened state of the motor-operated expansion valve (5) is indicated as 480 pulses, and then fully closes it. Further, the superheating control means (14) outputs a full-close holding signal to the defrosting executing means (11) so that the motor-operated expansion valve (5) holds for a set time a fully closed state after opened and closed. In detail, the superheating control means (14) activates the timer for one minute after the output of the opening and closing signals and prohibits the second and later times opening/closing operations until one minute passes.

The operation shifting means (15) executes the shift from defrosting operation to heating cycle operation when the defrosting executing means (11) completes defrosting operation, so as to control the open/shut-off valve (SV) to hold it open for a set time in a heating cycle and then turn it closed while controlling the motor-operated expansion valve (5) to gradually open it to a specified opening. In detail, the operation shifting means (15) opens the open/shut-off valve (SV) for two minutes after the completion of defrosting operation and then closes it, while executing gradually opening control of the motor-operated expansion valve (5) for three minutes after the completion of defrosting operation in such a manner as to once open the motor-operated expansion valve (5) of a fully closed state to 80 pulses, hold it in the partially opened state for 10 seconds, and then open it by 2 pulses in every five seconds or open it by 1 pulse in every 10 seconds when the outdoor-air temperature Ta is 23° C. or less.

Defrosting operation in Embodiment 1

Figure 4:
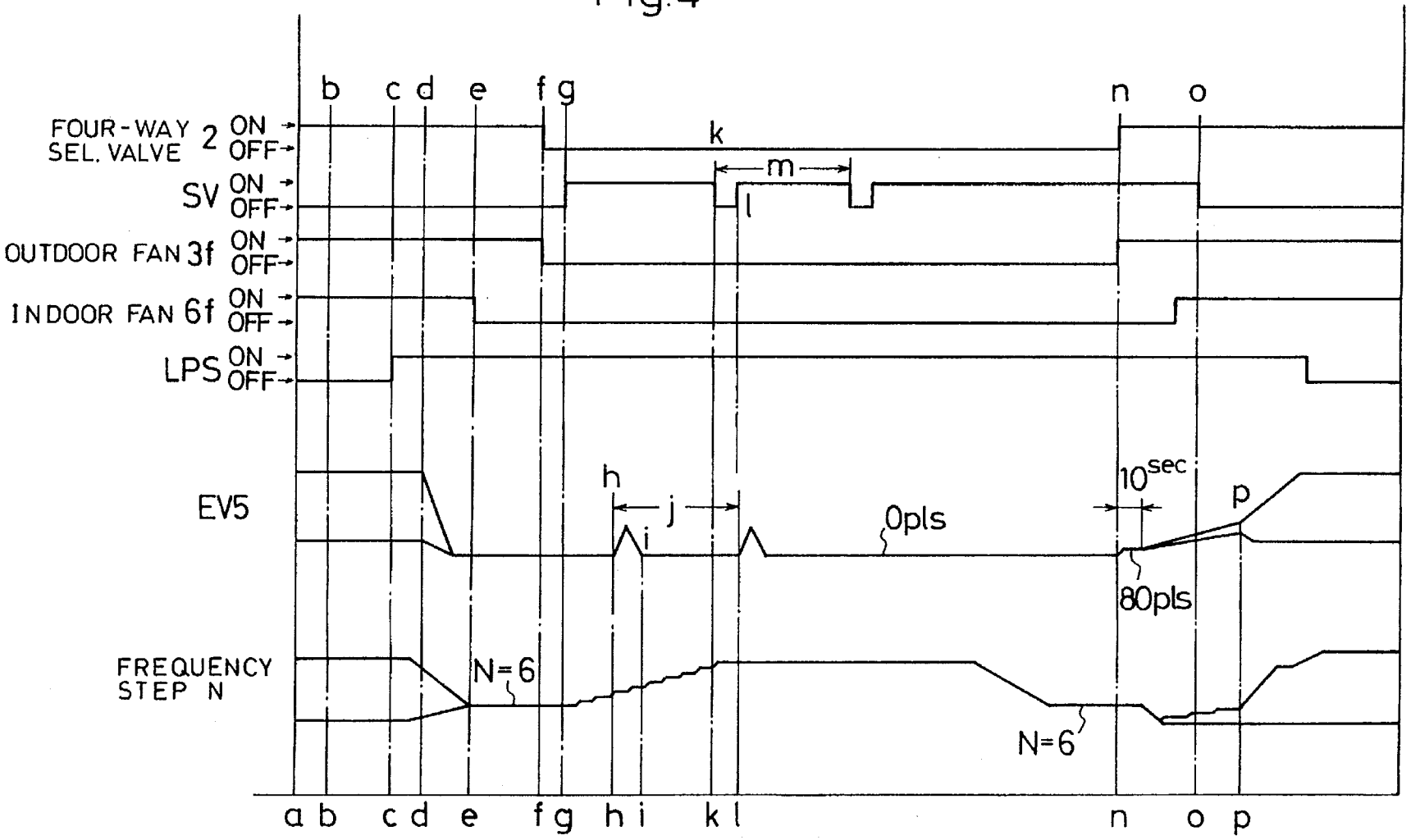
FIG. 4 is a timing chart showing the control of defrosting operation.

Next, description will be made about controls of defrosting operation of the air conditioner above-mentioned, with reference to a timing chart of FIG. 4.

First, in heating cycle operation, the four-way selector valve (2) is turned to an ON state as shown from a point a to point b, that is, switched to the broken line shown in FIG. 2, to fuzzy-control the opening of the motor-operated expansion valve (5) and the frequency step N of the compressor (1) so as to be an optimum discharge-pipe temperature, thereby performing heating operation.

At the point b, the controller (10) outputs a defrosting requiring signal according to a mean value of heating performance. When the defrosting requiring signal is outputted, defrosting operation waits until preparation of defrosting operation in the indoor unit (B) is completed at a point c, e.g., until treatment on a heater or the like is completed, the low-pressure-control pressure switch (LPS) is masked and then defrosting operation further waits for 35 seconds to a point d, i.e., to the time that the frequency step N of the compressor (1) to switch the four-way selector valve (2), which is 6, comes.

Thereafter, from the point d, fully closing operation for making the opening of the motor-operated expansion valve (5) into 0 pulse is started and liquid refrigerant stored in the outdoor heat exchanger (3) is recovered. When the time sufficient for fully closing the motor-operated expansion valve (5) has passed, the indoor fan (6*f*) is deactivated at a point e and heat storage in the indoor heat exchanger (6) is executed with high-pressure refrigerant.

This heat storage operation is completed when it has been executed for at most 10 seconds, when the indoor heat-exchange temperature Te rises above 35° C., when the outdoor heat-exchange temperature Tc drops below −30° C., or when the present outdoor heat-exchange temperature Tc drops 4° C. more than the outdoor heat-exchange temperature Tc at the time before the heat storage is started (See a point f).

At this point f, the defrosting executing means (11) deactivates the outdoor fan (3*f*), switches the four-way selector valve (2), i.e., switches according to the defrosting requiring signal the four-way selector valve (2) as shown in the solid line of FIG. 2 to set it to a cooling cycle, and feeds to the outdoor heat exchanger (3) high-temperature refrigerant discharged from the compressor (1) to start defrosting operation in the reverse cycle.

As a feature of this invention, when the defrosting operation is started, the defrosting executing means (11) ordinarily closes the motor-operated expansion valve (5) into a fully closed state of 0 pulse and opens the open/shut-off valve (SV), thereby shutting off the common passage (8*a*) and opening the bypass passage (4*a*). However, since the initial control means (12) outputs an initially closing signal, the open/shut-off valve (SV) is closed so that the common passage (8*a*) and the bypass passage (4*a*) are shut off until 15 seconds passes.

In detail, switching of the four-way selector valve (2) reverses the pressure distribution of refrigerant in the refrigerant circuit (9) to make the refrigerant pressure in the receiver (4) higher than the respective refrigerant pressures in the outdoor heat exchanger (3) and the indoor heat exchanger (6). If under such conditions the motor-operated expansion valve (5) and the open/shut-off valve (SV) remain opened, liquid refrigerant of high-temperature and high-pressure flows through the outdoor heat exchanger (3) and the indoor heat exchanger (6). Further, in such a case, liquid refrigerant is evaporated in the indoor heat exchanger (6), and refrigerant thus evaporated expels liquid refrigerant from the indoor heat exchanger (6) so that liquid refrigerant excessively flows into the compressor (1), while liquid refrigerant flowing into the outdoor heat exchanger (3) reduces a condensation area. As a result, defrosting performance is reduced. To solve this problem, as mentioned above, the motor-operated expansion valve (5) and the open/shut-off valve (SV) are closed thereby preventing the discharge of liquid refrigerant from the receiver (4).

Thereafter, when 15 seconds has passed, the defrosting executing means (11) opens the open/shut-off valve (SV) at a point g to execute ordinary defrosting operation and gradually increases the operational frequency N of the compressor (1).

Then, refrigerant discharged from the compressor (1) is condensed in the outdoor heat exchanger (3) to dissolve frost and flows into the receiver (4). From the receiver (4), gas refrigerant flows into the indoor heat exchanger (6) via the bypass passage (4*a*) and returns to the compressor (1). By such circulation of refrigerant, defrosting operation is executed.

Subsequently, when the discharge-pipe temperature Td rises above 90° C. in the defrosting operation, between a point h and a point i the superheating control means (14) outputs respective signals for opening and closing the motor-operated expansion valve (5) to once open the motor-operated expansion valve (5) to 200 pulses and then close it. In detail, gas refrigerant is discharged from the receiver (4) and flows through the bypass passage (4*a*). However, in the case of defrosting at a high open-air temperature or the case of long refrigerant piping, it readily becomes short of refrigerant so that the compressor (1) causes operation in superheated condition thereby increasing the discharge-pipe temperature Td.

To cope with this problem, the superheating control means (14) once opens the motor-operated expansion valve (5) to introduce liquid refrigerant in the receiver (4) into the indoor heat exchanger (6) through the downstream-side common passage (8Y) as shown in FIG. 3, thereby preventing the operation in superheated condition.

The opening/closing operation of the motor-operated expansion valve (5) is executed a single time in every one minute. In detail, as shown in a term j, after outputting an opening signal and a closing signal, the superheating control means (14) outputs a full-close holding signal so that the motor-operated expansion valve (5) holds for one minute the fully closed state after opened and closed, thereby prohibiting the excessive opening/closing operation.

On the other hand, when the discharge-pipe temperature Td drops below 85° C. in the defrosting operation, between a point k and a point l the wet condition control means (13) outputs a closing signal for the open/shut-off valve (SV) to hold the open/shut-off valve (SV) closed for 20 seconds. In detail, gas refrigerant is discharged from the receiver (4) and flows through the bypass passage (4*a*). However, if the receiver (4) is filled with liquid refrigerant, liquid refrigerant turns back to the compressor (1) through the indoor heat exchanger (6) so that the compressor (1) operates in wet condition, thereby decreasing the discharge-pipe temperature Td. To cope with this problem, the wet condition control means (13) closes the open/shut-off valve (SV) and shuts off the common passage (8*a*) and the bypass passage (4*a*) to prevent liquid refrigerant from turning back, thereby preventing the operation in wet condition.

The closing operation of the open/shut-off valve (SV) is executed a single time in every 50 seconds. In detail, as shown in a term m, after outputting a closing signal, the wet condition control means (13) outputs an opening holding signal so that the open/shut-off valve (SV) holds for 50 seconds the opened state after closed, thereby prohibiting the excessive closing operation.

Thereafter, in any one of the case that the frequency step N of the compressor (1) drops to 6, the case that the discharge-pipe temperature Td rises above 110° C., and the case that the defrosting operation period becomes longer than 10 minutes, as shown in a point n, the defrosting executing means (11) completes defrosting operation, turns the four-way selector valve (2) to an ON state to switch it as shown in the broken line of FIG. 2 and activates the outdoor fan (3*f*), thereby starting heating operation in a hot start. At the time just before the defrosting operation is completed, the frequency step N of the compressor (1) is set to become 6 without exception according to the timer or the discharge-pipe temperature Td.

Then, when the defrosting operation is completed, between a point n and a point o the operation shifting means (15) opens the open/shut-off valve (SV) for 2 minutes and then closes it to prevent the short of refrigerant, while between the point n and a point p the operation shifting means (15) gradually opens the motor-operated expansion valve (5) to prevent the operation in wet condition. In detail, the operation shifting means (15) first opens the motor-operated expansion valve (5) in a partially opened state of 80 pulse, holds it in this state for 10 seconds, then opens the motor-operated expansion valve (5) by 2 pulses in every 5 seconds or opens it by 1 pulse in every 10 seconds in the case of the outdoor-air temperature Ta of 23° C. or less, and fuzzy-controls the opening of the motor-operated expansion valve (5) and the frequency step N of the compressor (1) so as to become the optimum discharge-pipe temperature, thereby restarting normal heating operation.

Characteristic Effects of Embodiment 1

According to the present embodiment, since the open/shut-off valve (SV) is opened in defrosting operation so that gas refrigerant in the receiver (4) is introduced into the main line (9*a*) via the bypass passage (4*a*), when liquid refrigerant condensed in the outdoor heat exchanger (3) is stored in the receiver (4) in the case of heavy frost, low open-air temperature or short refrigerant piping, liquid refrigerant in the receiver (4) can be securely prevented from turning back to the compressor (1) without provision of any accumulator. As a result, operation in wet condition of the compressor (1) can be securely prevented so that the compressor (1) is subjected to no stress, thereby enhancing reliability of the compressor (1).

Further, since no accumulator is needed, pressure loss can be decreased thereby enhancing operation performance, and the number of elements can be reduced thereby resulting in cost reduction.

Furthermore, since the motor-operated expansion valve (5) and the open/shut-off valve (SV) are closed at the initial stage of the defrosting operation, it can be securely prevented that liquid refrigerant in the receiver (4) flows into the outdoor heat exchanger (3) and the indoor heat exchanger (6) due to variation in pressure of the refrigerant circuit caused by switching the four-way selector valve (2). Thus, turning back of liquid refrigerant to the compressor (1) can be prevented and a condensation area in the outdoor heat exchanger (3) can be sufficiently ensured, so that defrosting performance can be increased.

Further, since the open/shut-off valve (SV) is closed when the discharge-pipe temperature Td drops in the defrosting operation, liquid refrigerant on a suction side of the compressor (1) can be evaporated. Consequently, turning back of liquid refrigerant can be prevented so that operation in wet condition of the compressor (1) can be securely prevented, thereby further enhancing reliability of the compressor (1).

Furthermore, since the open/shut-off valve (SV) once closed is held in an opened state for a set time, the compressor (1) can be prevented in advance from operating in superheated condition due to frequent closing control of the open/shut-off valve (SV).

Further, since the motor-operated expansion valve (5) is opened when the discharge-pipe temperature Td rises in the defrosting operation, liquid refrigerant is turned back to cool down superheated refrigerant on a suction side of the compressor (1), so that operation in superheated condition of the compressor (1) can be securely prevented thereby further enhancing reliability of the compressor (1).

Furthermore, since the motor-operated expansion valve (5) is once opened and is then held in a fully closed state for a set time, the compressor (1) can be prevented in advance from operating in wet condition due to frequent opening/closing control of the motor-operated expansion valve (5). In other words, the wet condition control means (13) and the superheating control means (14) hold the discharge-pipe temperature Td in an optimum temperature so that the compressor (1) is subjected to no stress.

Moreover, when the defrosting operation is completed, the open/shut-off valve (SV) is opened and the motor-operated expansion valve (5) is gradually opened. Since this ensures the minimum circulation amount of refrigerant at the shift to heating operation, heating performance can be increased. Further, since turning back of liquid refrigerant to the compressor (1) can be prevented, operation in wet condition of the compressor (1) can be prevented while dilution of lubricating oil in the compressor (1) can be prevented.

Modification of Embodiment 1

Figure 5:
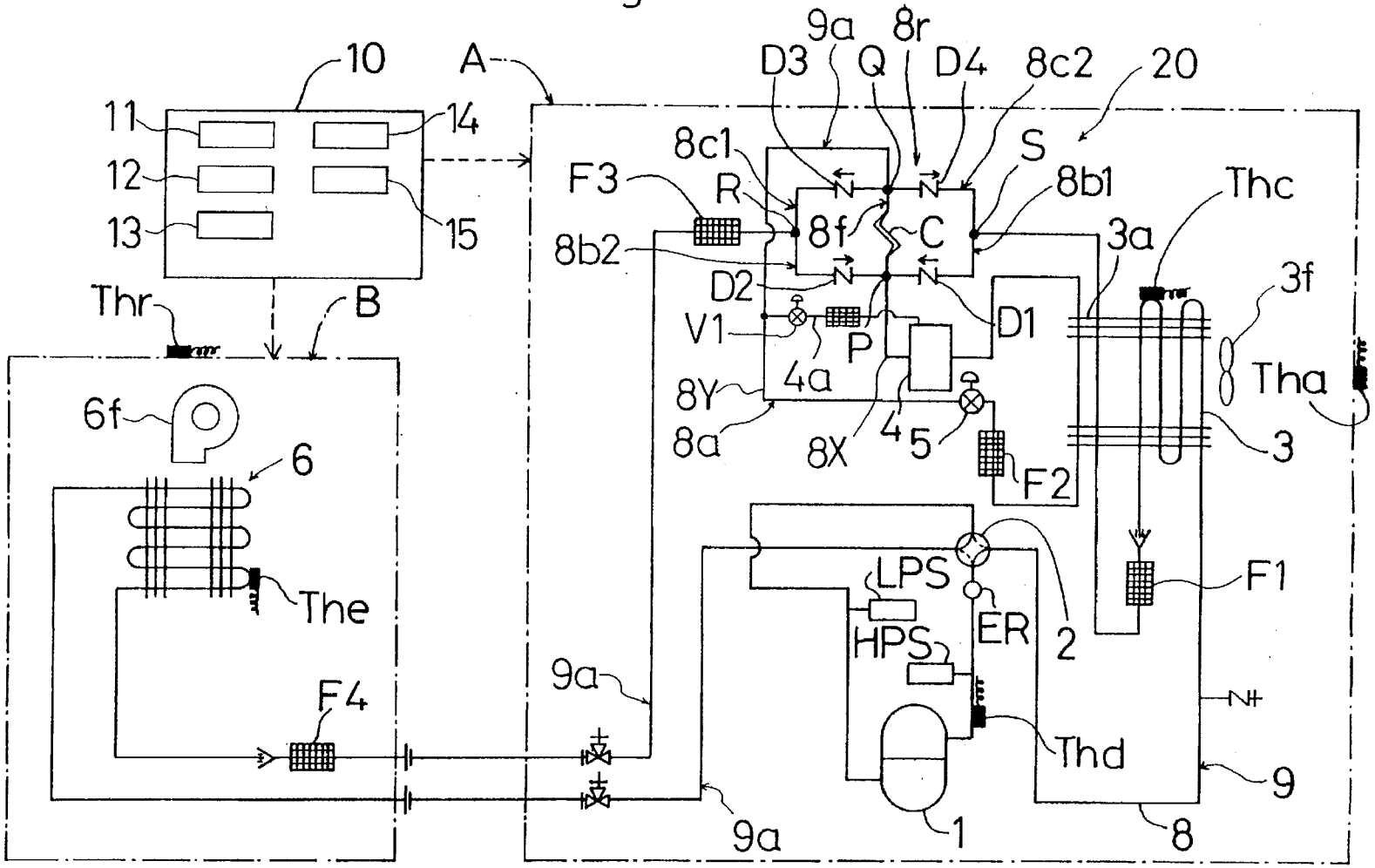
FIG. 5 is a refrigerant circuit diagram showing another embodiment of the invention.

FIG. 5 shows a motor-operated valve (V1) freely adjustable in opening, which is substituted for the open/shut-off valve (SV) of the above embodiment. Other structure, operations and effects are the same as in the above embodiment. The opening of the motor-operated valve (V1) may be controlled into a fully opened state and a fully closed state, or may be otherwise adjusted according to the discharge-pipe temperature Td or the like.

Embodiment 2

Figure 6:
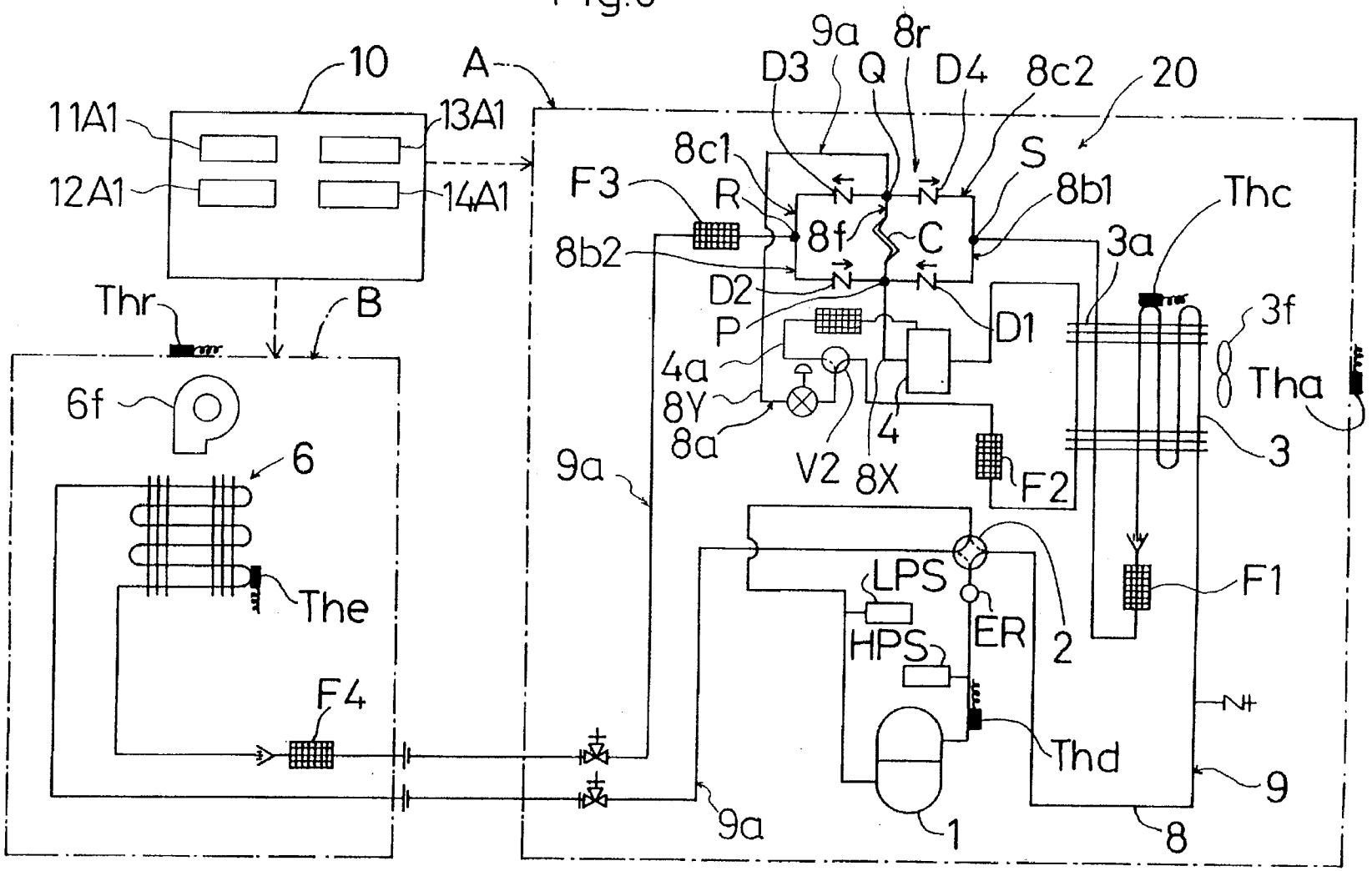
FIG. 6 is a refrigerant circuit diagram showing another embodiment of the invention.

FIG. 6 shows another embodiment of the invention. In the present embodiment, a three way valve (V2) is substituted for the open/shut-off valve (SV) of the above embodiment, and the bypass passage (4*a*) is connected to a high-pressure side of the motor-operated expansion valve (5).

The three way valve (V2) forms a selector means switchable between a bypass communication state in which the high-pressure side of the motor-operated expansion valve (5) is communicated with the bypass passage (4*a*) and a main line communication state in which the high-pressure side of the motor-operated expansion valve (5) is communicated with the common passage (8*a*) of the main line (9*a*).

Structure and Operation of Defrosting Operation Control of Embodiment 2

Description will be made about the structure and operations of defrosting operation control in an embodiment of FIG. 6, with reference to the timing chart of FIG. 4.

First, when the defrosting executing means (11A1) starts defrosting operation at a point f, it switches the four-way selector valve (2) as shown in the solid line of FIG. 6 and switches the three way valve (V2) as shown in the broken line of. FIG. 6, so that the bypass passage (4*a*) is communicated with the motor-operated expansion valve (5) thereby resulting in the bypass communication state. Further, the initial control means (12A1) controls the motor-operated expansion valve (5) to hold it in a fully closed state for 15 seconds in correspondence with the closure of the open/shut-off valve (SV) in the before-mentioned embodiment (See points f to g of FIG. 4).

Thereafter, the motor-operated expansion valve (5) is opened at a specified opening and is held in the specified opening, so that gas refrigerant in the receiver (4) is introduced toward the indoor heat exchanger (6) through the bypass passage (4*a*) thereby executing defrosting operation. When the discharge-pipe temperature Td rises above 90° C. in the defrosting operation, the superheating control means (14A1) outputs a switching signal to switch the three way valve (V2) as shown in the solid line of FIG. 6 thereby forming the main line communication state. Then, the superheating control means (14A1) switches again the three way valve (V2) as shown in the broken line of FIG. 6 thereby forming the bypass communication state, and subsequently outputs a switching holding signal to hold the bypass communication state for a set time (See points h to i and a term j of FIG. 4). In other words, because the compressor (1) is on its way to superheated condition, operation in superheated condition is prevented by the introduction of liquid refrigerant in the receiver (4) toward the indoor heat exchanger (6).

On the other hand, when the discharge-pipe temperature Td drops below 85° C., the wet condition control means (13A1) outputs a fully closing signal to make the motor-operated expansion valve (5) fully closed for 20 seconds, and subsequently outputs a full-close holding signal to hold the motor-operated expansion valve (5) in a specified opened state for 30 seconds (See points k to l and a term m of FIG. 4). In other words, because the compressor (1) is on its way to wet condition, the common passage (8*a*) and the bypass passage (4*a*) are shut off together thereby preventing the operation in wet condition.

Thereafter, when the defrosting operation is completed (See a point n of FIG. 4), the four-way selector valve (2) is switched as shown in the broken line of FIG. 6 and the three way valve (V2) is switched as shown in the solid line of FIG. 6 so that the main line communication state is formed, while the motor-operated expansion valve (5) is opened to a target opening. Thus, normal heating operation is restarted.

Other structure and operations are the same as in the before-mentioned embodiment. Accordingly, in the present embodiment, similar to the before-mentioned embodiment, operation in wet condition and operation in superheated condition of the compressor (1) can be securely prevented without any accumulator, thereby enhancing operation performance and reliability of the compressor (1).

Embodiment 3

Figure 7:
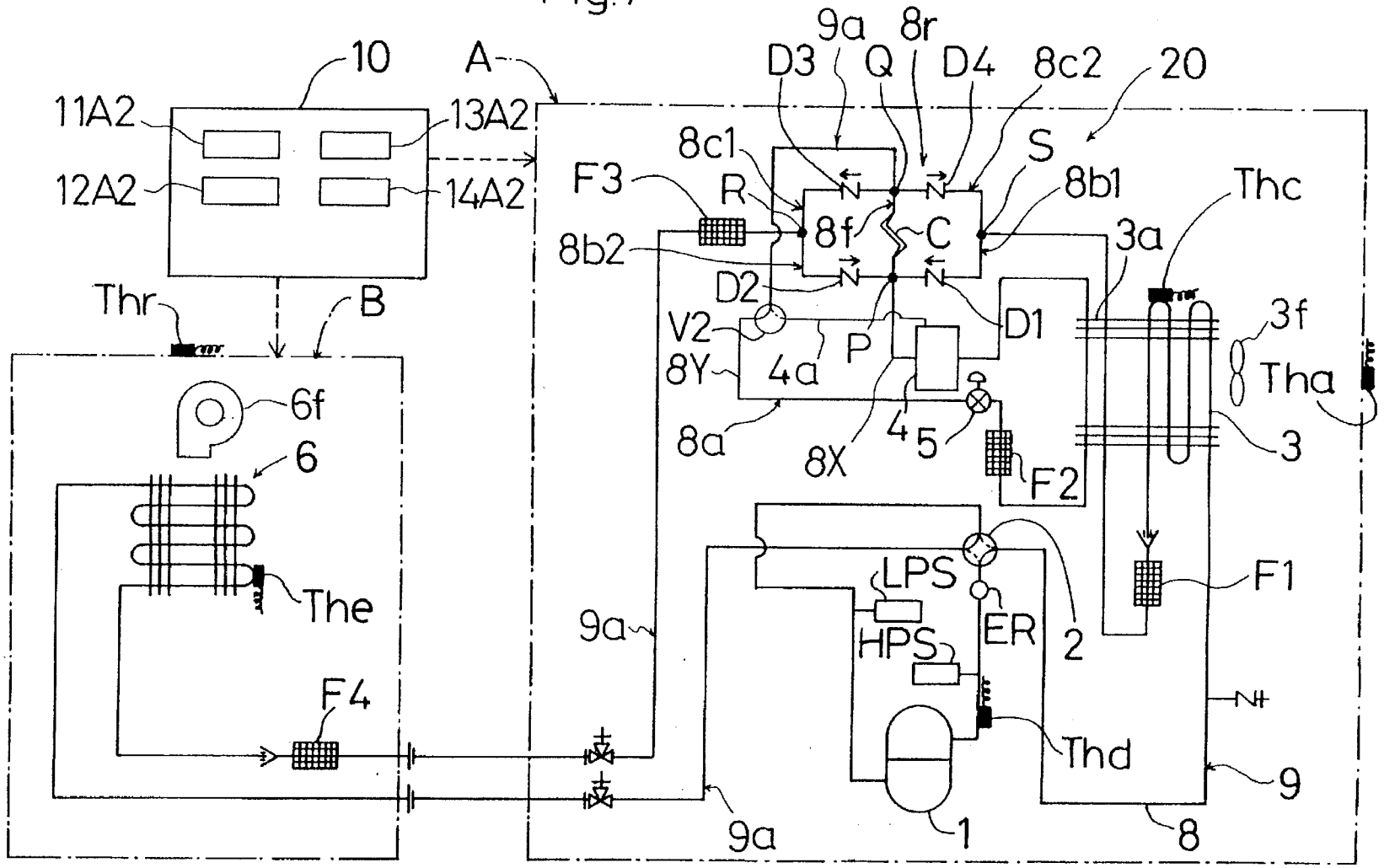
FIG. 7 is a refrigerant circuit diagram showing another embodiment of the invention.

FIG. 7 shows another embodiment of the invention. In the present embodiment, the bypass passage (4*a*) is connected to a low-pressure side of the motor-operated expansion valve (5) instead of being connected to the high-pressure side of the motor-operated expansion valve (5) in the above embodiment of FIG. 6.

The three way valve (V2) forms a selector means switchable between a bypass communication state in which the down-stream-side common passage (8Y) is communicated with the bypass passage (4*a*) and a main line communication state in which the downstream-side common passage (8Y) is communicated with the common passage (8*a*).

Structure and Operation of Defrosting Operation Controls of Embodiment 3

Description will be made about the structure and operations of defrosting operation control in an embodiment of FIG. 7, with reference to the timing chart of FIG. 4.

First, when the defrosting executing means (11A2) starts defrosting operation at a point f, it switches the four-way selector valve (2) as shown in the solid line of FIG. 7 and switches the three way valve (V2) as shown in the broken line of FIG. 7, so that the bypass passage (4*a*) the bypass passage (4*a*) is communicated with the downstream-side common passage (8Y), thereby resulting in the bypass communication state. Further, the initial control means (12A2) holds the three way valve (V2) in the main line communication state shown in the solid line of FIG. 7 while controlling the motor-operated expansion valve (5) to hold it in a fully closed state for 15 seconds in correspondence with the closure of the open/shut-off valve (SV) in the before-mentioned embodiment (See points f to g of FIG. 4).

Thereafter, the defrosting executing means (11A2) switches the three way valve (V2) as shown in the broken line of FIG. 7 to form the bypass communication state, so that gas refrigerant in the receiver (4) is introduced toward the indoor heat exchanger (6) through the bypass passage (4*a*) thereby executing defrosting operation. When the discharge-pipe temperature Td rises above 90° C. in the defrosting operation, the superheating control means (14A2) .outputs a switching signal to switch the three way valve (V2) as shown in the solid line of FIG. 7 thereby forming the main line communication state, and opens the motor-operated expansion valve (5) to a specified opening. Then, the superheating control means (14A2) switches again the three way valve (V2) as shown in the broken line of FIG. 7 thereby forming the bypass communication state, and subsequently outputs a switching holding signal to hold the bypass communication state for a set time (See points h to i and a term j of FIG. 4). In other words, because the compressor (1) is on its way to superheated condition, operation in superheated condition is prevented by the introduction of liquid refrigerant in the receiver (4) toward the indoor heat exchanger (6).

On the other hand, when the discharge-pipe temperature Td drops below 85° C., the wet condition control means (13A2) outputs a switching signal to switch the three way valve (V2) as shown in the solid line of FIG. 7 thereby forming the main line communication state, and makes the motor-operated expansion valve (5) fully closed for 20 seconds. Then, the wet condition control means (13A2) switches again the three way valve (V2) as shown in the broken line of FIG. 7 thereby forming the bypass communication state, and subsequently outputs a switching holding signal to hold the bypass communication state for a set time (See points k to l and a term m of FIG. 4). In other words, because the compressor (1) is on its way to wet condition, the common passage (8*a*) and the bypass passage (4*a*) are shut off together thereby preventing the operation in wet condition.

Thereafter, when the defrosting operation is completed (See a point n of FIG. 4), the four-way selector valve (2) is switched as shown in the broken line of FIG. 7 and the three way valve (V2) is switched as shown in the solid line of FIG. 7 so that the main line communication state is formed, while the motor-operated expansion valve (5) is opened to a target opening. Thus, normal heating operation is restarted.

Other structure and operations are the same as in the before-mentioned embodiment of FIG. 2. Accordingly, in the present embodiment, similar to the before-mentioned embodiment, operation in wet condition and operation in superheated condition of the compressor (1) can be securely prevented, thereby enhancing reliability of the compressor (1).

Embodiment 4

Figure 8:
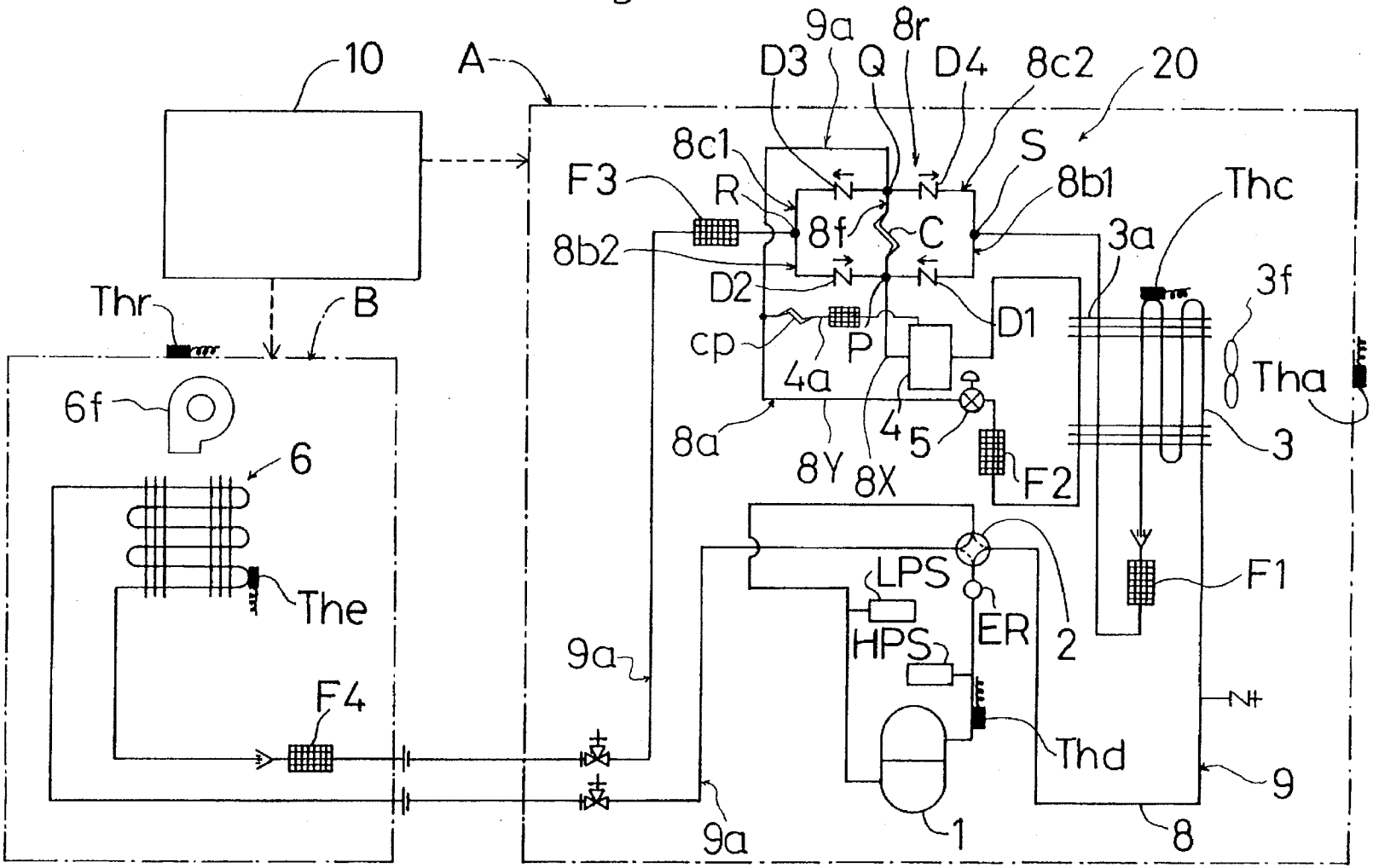
FIG. 8 is a refrigerant circuit diagram showing another embodiment.

FIG. 8 shows another embodiment of this invention. In the present embodiment, a capillary (CP) is provided instead of the open/shut-off valve (SV) of the embodiment of FIG. 2.

Accordingly, in defrosting operation, the motor-operated expansion valve (5) is fully closed so that gas refrigerant in the receiver (4) flows through the bypass passage (4*a*).

Other Modifications

In the above embodiments, operation control of the compressor (1) in wet condition and in superheated condition in defrosting operation is executed in such a manner that the open/shut-off valve (SV), the motor-operated expansion valve (5) and the like are opened and closed. However, the bypass passage (4*a*) may be communicated at any time during defrosting operation.

Further, the compressor (1) may be controlled based on a pressure of refrigerant on the discharge side.

Furthermore, the refrigerant circuit (9) is not limited to the above embodiments. For example, it may be a refrigerant circuit having no rectification circuit (8*r*).

INDUSTRIAL APPLICABILITY

As described so far, an operation control device for air conditioner of this invention is useful for air conditioners having no accumulator.

We claim:

1. In an air conditioner comprising a refrigerant circuit (9) which has a main line (9*a*) in which a compressor (1), a thermal-source-side heat exchanger (3), an expansion mechanism (5) freely adjustable in opening and a used-side heat exchanger (6) are sequentially connected, said refrigerant circuit (9) being reversibly operable between cooling cycle operation and heating cycle operation, an operation control device for said air conditioner comprising:

a receiver (4) for storing liquid refrigerant, said receiver being provided in a high-pressure liquid line of the main line (9*a*) of the refrigerant circuit (9);

a bypass passage (4*a*) for bypassing the expansion mechanism (5) to introduce gas refrigerant in the receiver (4) into a low-pressure liquid line of the main line (9*a*) of the refrigerant circuit (9), said bypass passage (4*a*) being connected at one end thereof to the receiver (4) and at the other end to the low-pressure liquid line;

open/shut-off means (SV) for opening and shutting off the bypass passage (4*a*), said open/shut-off means (SV) being provided in the bypass passage (4*a*); and defrosting executing means (11) for making the expansion mechanism (5) fully closed and making the open/shut-off means (SV) open according to a defrosting requiring signal in the heating cycle operation and executing defrosting operation in the reverse cycle.

2. An operation control device for air conditioner according to claim 1, further comprising initial control means (12) for outputting an initially closing signal to the defrosting executing means (11) so that the open/shut-off means (SV) is closed until a set time passes after the start of the defrosting operation.

3. An operation control device for air conditioner according to claim 1, further comprising wet condition control means (13) for outputting a closing signal to the defrosting executing means (11) so that the open/shut-off means (SV) is closed when a refrigerant temperature on a discharge side of the compressor (1) drops to or below a specified temperature.

4. An operation control device for air conditioner according to claim 3, wherein the wet condition control means (13) outputs a closing signal to the defrosting executing means (11) so that the open/shut-off means (SV) becomes an opened state after holding a closed state for a set time, and then outputs an opening holding signal to the defrosting executing means (11) so that the open/shut-off means (SV) holds the opened state for a set time after closed.

5. An operation control device for air conditioner according to claim 1, further comprising superheating control means (14) for outputting respective signals for opening and closing the motor-operated expansion valve (5) to the defrosting executing means (11) so that when a refrigerant temperature on a discharge side of the compressor (1) rises to or above a specified temperature, the expansion mechanism (5) is opened to a specified opening and then closed into a fully closed state.

6. An operation control device for air conditioner according to claim 5, wherein the superheating control means (14) outputs a full-closing holding signal to the defrosting executing means (11) so that the expansion mechanism (5) holds the fully closed state for a set time after opened and closed.

7. An operation control device for air conditioner according to any one of claims 1 to 6, further comprising operation sifting means (15) for shifting the circuit to the heating cycle operation when the defrosting executing means (11) completes the defrosting operation, so as to control the open/shut-off means (SV) to hold it open for a set time in a heating cycle and then turn it closed while controlling the expansion mechanism (5) to gradually open it to a specified opening.

* * * * *